United States Patent [19]

Bodnar

[11] Patent Number: 4,909,007

[45] Date of Patent: Mar. 20, 1990

[54] STEEL STUD AND PRECAST PANEL

[75] Inventor: Ernest R. Bodnar, 2 Danrose Crescent, Toronto, Ontario, Canada, M3B 3N5

[73] Assignee: Ernest R. Bodnar, Toronto, Canada

[21] Appl. No.: 269,113

[22] Filed: Nov. 9, 1988

Related U.S. Application Data

[63] Continuation-in-part of Ser. No. 28,094, Mar. 19, 1987, abandoned, which is a continuation-in-part of Ser. No. 805,741, Dec. 6, 1985, abandoned.

[51] Int. Cl.[4] ..... E04B 1/14

[52] U.S. Cl. ..... 52/356; 52/602; 52/634; 52/722

[58] Field of Search ..... 52/634, 647, 735, 351, 52/356, 359, 363, 481, 630, 338, 600, 602, 729, 722

[56] References Cited

U.S. PATENT DOCUMENTS

| | | | |
|---|---|---|---|
| 696,062 | 3/1902 | Marsden | 52/356 |
| 815,292 | 3/1906 | Hegbom | 52/359 |
| 917,478 | 4/1909 | Noble | 52/359 |
| 963,938 | 7/1910 | Philips | 52/356 |
| 1,516,480 | 11/1924 | Whittmore | 52/634 X |
| 1,685,247 | 9/1928 | Selway | 52/356 |
| 1,799,337 | 4/1930 | Warhus | 52/634 |
| 1,936,147 | 11/1933 | Young | 52/356 |
| 2,088,781 | 8/1937 | Folsom | 52/634 |
| 2,092,472 | 9/1937 | Rafter | 52/634 |
| 2,092,752 | 9/1937 | Davis | 52/602 |
| 2,145,407 | 1/1939 | Soule | 52/274 |
| 2,157,233 | 5/1939 | Geib, Jr. | 52/634 |
| 2,159,182 | 5/1939 | Schalmann | 52/356 |
| 2,167,666 | 8/1939 | McGee | 52/634 |
| 2,177,277 | 10/1939 | Burke | 52/634 |
| 2,315,687 | 4/1943 | Burke | 52/632 |
| 2,950,789 | 8/1960 | Davis, Jr. et al. | 52/731 X |
| 3,073,068 | 1/1963 | Slowinski | 52/359 |
| 3,217,460 | 11/1965 | Downing, Jr. | 52/735 |
| 3,284,979 | 11/1966 | Edwards . | |
| 3,308,487 | 3/1967 | Birgbauer, Jr. | 52/735 |
| 3,332,197 | 7/1967 | Hinkle | 52/731 |
| 3,363,371 | 1/1968 | Villalobos . | |
| 3,381,439 | 5/1968 | Thulin, Jr. | 52/729 |
| 3,401,497 | 9/1968 | Gregory, Jr. et al. | 52/647 |
| 3,533,205 | 10/1970 | Pestel et al. | 52/356 |
| 3,802,147 | 4/1974 | O'Konski | 52/356 |
| 3,940,899 | 3/1976 | Balinski | 52/735 |
| 4,387,544 | 6/1983 | Schilger et al. | 52/405 |
| 4,566,240 | 1/1986 | Schilger | 52/414 |
| 4,602,467 | 7/1986 | Schilger | 52/319 |
| 4,653,237 | 3/1987 | Taft | 52/335 |

FOREIGN PATENT DOCUMENTS

| | | | |
|---|---|---|---|
| 110658 | 6/1940 | Australia | 52/356 |
| 84618 | 7/1921 | Austria | 52/735 |
| 922864 | 3/1973 | Canada . | |
| 1134162 | 10/1982 | Canada . | |
| 1178819 | 12/1984 | Canada . | |
| 1192015 | 8/1985 | Canada . | |
| 41817 | 4/1933 | France | 52/634 |
| 1200845 | 12/1959 | France | 52/735 |
| 441683 | 1/1968 | Switzerland | 52/356 |
| 126776 | 5/1919 | United Kingdom | 52/735 |
| 157312 | 7/1922 | United Kingdom | 52/693 |
| 826854 | 1/1960 | United Kingdom | 52/634 |

OTHER PUBLICATIONS

Dofasco Galvanised Steel—date unknown.
Dofasco Steel Thermal Stud—date Jun. 1981.

*Primary Examiner*—Carl D. Friedman
*Assistant Examiner*—Caroline D. Dennison

[57] ABSTRACT

A precast panel having a slab of cast material having a first surface, and a plurality of steel studs on one side, the steel studs having two angle members parallel to one another, a plurality of struts extending from one angle member to the other, openings between the struts, junction flanges extending from one of the angle members, and a locking strip formed on the junction flange, the locking strip defining an acute angle with the first surface of the slab and junction flange being embedded in the cast material, and the junction flange being discontinuous and defining openings through which the cast material extends to integrally bond the cast material on opposite sides of the the junction flange.

6 Claims, 2 Drawing Sheets

STEEL STUD AND PRECAST PANEL

This application is a continuation-in-part of application Ser. No. 028,094, filed Mar. 19, 1987 now abandoned and entitled STEEL STUD AND PRECAST PANEL THEREFOR which was a continuation-in-part of application Ser. No. 805,741 filed Dec. 6, 1985, Title: Steel Stud and Precast Panel, both of which applications have now been abandoned.

FIELD OF THE INVENTION

The invention relates to a composite precast panel incorporating steel studs.

BACKGROUND OF THE INVENTION

Precast panels, typically being finished on one side, offer numerous advantages in construction. In the majority of cases the cost of the building will be reduced, where precast panels are used. In addition, it is possible to design an exterior formation on the panel having an attractive appearance. In many cases the panel material is concrete, incorporating reinforcement. Typically the thickness of the concrete panelling will be between about one and two inches.

Panels of this thickness require some form of structural reinforcement to provide rigidity. In addition, where such panels are used for exterior load-bearing walls, then they must incorporate some form of structural members.

Typically, such panels will be erected in place to provide a finished exterior, and the interior of the panels will then be covered in and finished at a later stage.

In other applications, the interior of the panels may be prefinished in the factory and insulation may also be installed so that a complete wall system is achieved prior to installation.

Applications for such precast panels are in providing exterior wall systems for commercial and industrial buildings and high rise office buildings and apartments and the like, and also interior wall systems, if desired, with a variety of finishes.

In the majority of cases, such panelling systems are supported on the building structure, and do not normally provide any load bearing capacity, other than resistance to wind loads.

In these cases, the panels must be securely attached to the fabric of building.

The design of such precast panels must, however, be such that it meets all of the foregoing objectives in a satisfactory and efficient manner, and also at a reasonable cost. In most construction projects the actual weight of the material used in construction is of great importance. The weight of the materials affects both the cost of the materials and also the cost of shipping, and imposes limits on the manner in which the materials can be handled at the construction site.

In addition to all of these limitations, however, especially in the construction of high rise buildings, the weight of the construction materials is a critical factor in the design of the entire building.

Where a significant reduction in material weight can be achieved, then it becomes possible to optimize the design of the entire building and reduce construction costs. For all these reasons, therefore, it is desirable that the thickness of the precast panel shall be reduced to a minimum compatible with achieving these objectives.

Accordingly, developments in the design of such precast panelling have been along the lines of reducing the thickness of the panel, and incorporating metal structural studs or channels on the one side of the panel.

In this way, the exterior of the panel presents a finished appearance, and the interior of the panel has a plurality of metal studs or channels partially embedded in its surface.

Using these techniques, it has been found possible to construct precast panels of very considerable size, and of a thickness of between one and two inches.

Reinforcing steel is incorporated in the panels, and the structural steel studs have portions which are embedded in the concrete on one side of reinforcing steel web.

In the past, the steel stud used for this purpose has often been of a simple C-shaped channel, with one edge of the channel simply resting against the reinforcing steel mesh.

This however, is not always a satisfactory method of of attachment. The edge of the channel creates a line of weakness in the panel.

In addition the use of a simple C-shaped channel creates obstructions in the wall. If any electrical services are to be run through the wall, then the openings must be made through the channels.

Another significant problem has been heat transfer through the channels when the panels are used on the exterior of a building. The metal causes patches of cold on the interior walls of the building, resulting in condensation in and on the wall known as "ghosting". The heating load in the building is also increased.

The weight of the metal studs themselves is also a significant factor in the overall weight of the panels. Any reduction in weight that can be achieved, without loss in rigidity, will produce significant benefits.

In some cases it may be desirable to use such panels as floors or roofing, but in the past the studs have been inadequate to support the load.

For all of these reasons therefore it is desirable to provide a precast panel with steel studs which is designed so that the weight of the steel stud is reduced to a minimum, and having its own integral securing means for securing the stud to the precast slab and which incorporates openings along its length which effectively reduces heat transfer through the stud, and which avoids lines of weakness in the slab.

BRIEF SUMMARY OF THE INVENTION

With a view to achieving the various objectives set out above, the invention provides a precast panel a precast thin walled construction panel having low thermal conductivity and comprising a slab of cast concrete material having a first surface, and a plurality of parallel spaced apart steel stud members partially embedded in, and extending from said first surface of said slab, and each said stud member being an integral sheet metal structure and comprising two parallel spaced-apart structural members extending parallel to one another; a plurality of spaced-apart strut members extending integrally between said structural members, said strut members having openings therebetween; a junction flange integrally formed with and extending angularly from one of said structural members and embedded in said slab and having openings therethrough; and a locking strip integrally formed with said junction flange, disposed non-perpendicularly relative thereto and embedded in said slab inwardly of said first surface thereof, said locking strip being disposed within said slab at an acute angle to said first surface of said slab and extending to one side only of said junction flange, and said cast concrete material extending through said openings in said junction flange.

More particularly, it is an objective of the invention to provide a precast panel having stud members of the type described having additional reinforcement means on the angle member remote from said junction strip.

It is a further and related objective of the invention to provide a precast panel incorporating a plurality of stud members located in predetermined parallel spaced-apart relationship, extending from one edge to the other of said panel, and including upper and lower frame members extending between the upper and lower ends of said stud members, and panel material cast around said locking strips.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

The invention will now be described merely by way of illustration with reference to the accompanying drawings in which:

FIG. 5 is a fragmentary perspective view of an alternative embodiment of a stud member used in the invention; and FIG. 6 is a fragmentary perspective view of yet another embodiment of a stud member used in the invention.

DESCRIPTION OF THE PREFERRED EMBODIMENTS

Figure 1:
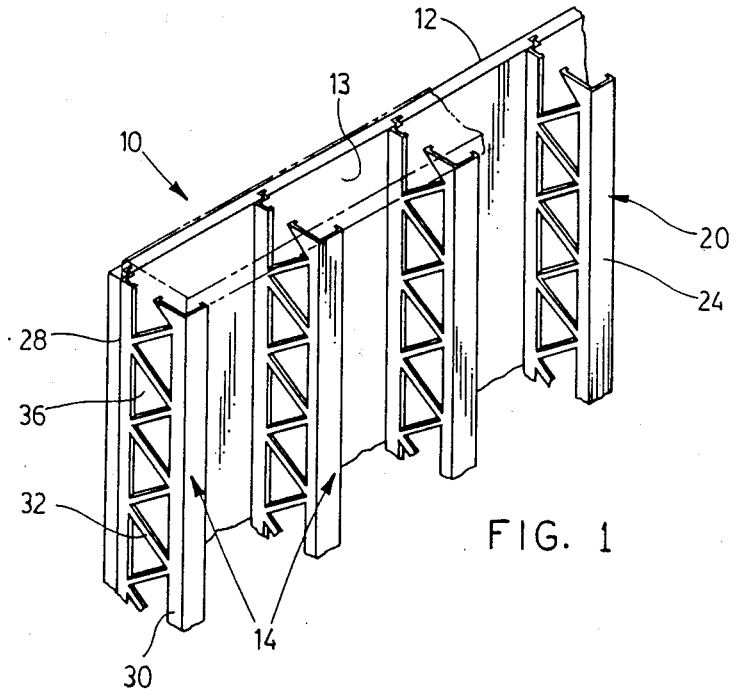
FIG. 1 is a perspective view of a typical precast panel according to the invention.

As shown in FIG. 1, a precast panel generally indicated at 10 comprises a slab 12 having a first surface 13 and typically formed of concrete, with a steel reinforcing mesh R (FIG. 3) embedded therein. A plurality of steel stud members generally indicated at 14 are attached on one side of the slab portion 12 and in a manner to be described below.

Figure 3:
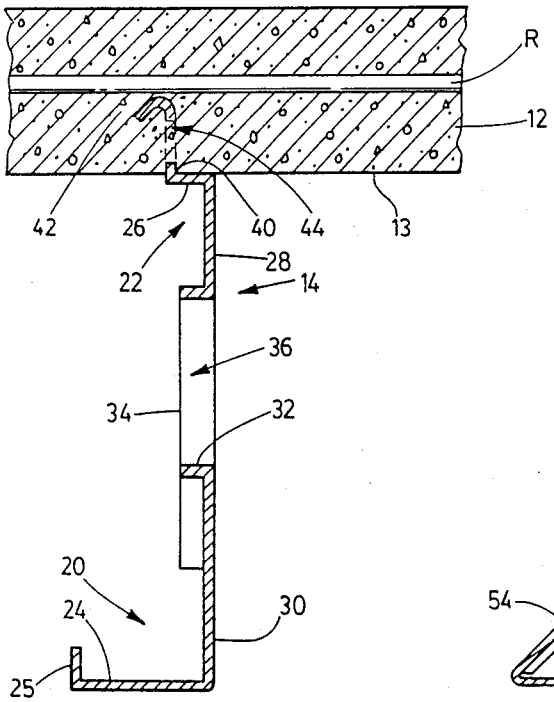
FIG. 3 is a fragmentary section through a typical panel incorporating the stud member shown in FIG. 2.
Figure 2:
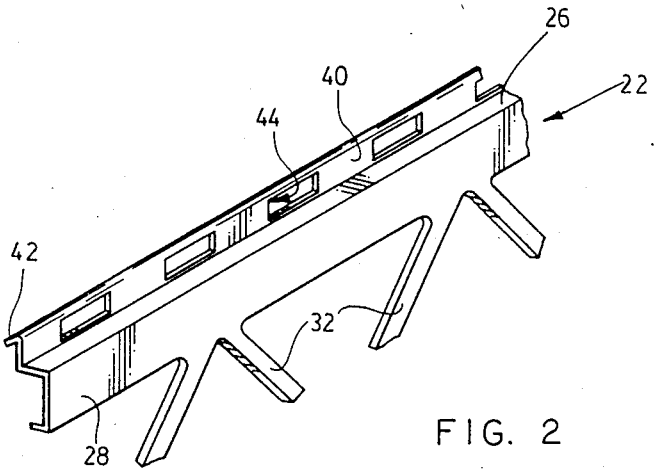
FIG. 2 is a fragmentary perspective view of one embodiment of a stud member used in a panel according to the invention.

As best shown in FIGS. 2 and 3, the stud member 14 comprises inner and outer generally L-shaped angle portions generally indicated at 20 and 22 respectively. Each of the angle portions 20 and 22 comprises respective flanges 24 and 26, and bracing flanges 28 and 30. The flange 24 is usefully formed with a reinforcing edge flange 25

Respective ones of the flanges 24, 26 and the bracing flanges 28, 30 form a right angle, so that the two flanges 24 and 26 are disposed in mutually parallel spaced-apart planes.

In order to join the two angle portions 20 and 22 together, angled struts 32 extend integrally between them. Struts 32 are usefully formed into a generally three-sided channel shape by means of turning down the edge flange portion 34 on one or both sides.

Angle portions 20 and 22 and struts 32 are all formed integrally out of a single piece of sheet metal. Typically they will be formed by roll forming techniques, with openings being blanked out between the struts 32.

Such openings are shown generally as 36. Studs of this type are considerably lighter than equivalent studs of conventional C-shape cross section. In addition, the forming of openings in the studs between the edges thereof both reduces the heat transfer through the stud, and at the same time provides adequate openings for passing services through the studs. If desired, the edges of the bracing flanges 28 and 30 can also be turned down so that the openings 36 are peripherally defined on all sides by integrally formed flanges.

In order to secure the studs in a precast panel a junction flange 40 extends from flange 26, at right angles thereto, and a locking strip 42 extends from junction flange 40 for securing the flange 40 in the concrete panel. As will best be understood by reference to FIG. 3, the locking strip 42 is, in accordance with an important feature of this invention, disposed at an acute angle to the first surface 13 of the slab 12.

Openings 44 are struck out of junction flange 40 as shown in FIG. 2, at intervals, to allow concrete to flow through during manufacture of the panel 10. Usefully, the openings 44 can be formed so as to extend into the locking strip 42 as will be more readily understood as alternative embodiemnts of such studs are hereinafter described.

In the manufacture of the composite precast panel 10, the stud members 14 are assembled together and fastened into a framework, similar to the framework used when erecting studding for a wall. That is to say, a plurality of the studs are arranged in mutually parallel spaced-apart locations typically on sixteen or twenty-four inch centers for example, and top and bottom struts may be attached at either end, if required.

The manufacture of the composite panel 10 then proceeds by pouring a sufficient depth of the precast material, typically concrete, into a horizontal mould. In a typical example it will be poured to a depth of about one and a half inches, the actual thickness depending upon various factors and design considerations.

The reinforcing mesh R is then placed on the surface of the concrete.

The entire rectangular framework of studs is then lowered down into the mould so as to rest on the reinforcing mesh and is then pressed downwardly part way into the concrete.

When the desired depth has been reached, the locking strip 42 and the junction flange 40 will be immersed in the concrete, and the flange 26 will typically be resting on the first surface 13 of the concrete.

The rectangular framework of studs may then be secured, if desired, so that it cannot sink any further, until the panel is set and cured.

Once cured, the entire panel is then freed from the mould.

It has not been found necessary to provide any attachment between the stud members and the reinforcing steel mesh in the concrete. However, for the sake of convenience, if some form of attachment is desired, for example, to assist in the actual assembly and casting of the panels, then the reinforcing mesh can be attached by simply looping wires (not shown) through the reinforcing mesh and through the openings 44, and typing them off at various intervals.

In most cases, however, it is simply a matter of first of all placing the reinforcing mesh on the poured concrete in the mould, and then lowering the framework consisting of studs down on to the reinforcing mesh, and continuing lowering the framework until it has entered the concrete to the desired depth.

This will also have the effect of forcing the reinforcing mesh into the concrete to the desired depth. In practice it is found that the reinforcing mesh will not sink any further, but will remain in the correct position.

Panels made in this way are found to exhibit great strength and durability. The studs are consequently securely fastened to the slab, enabling the panels to be moved, installed and fastened.

The low thermal conductivity of the studs substantially eliminates cold spots and condensation on interior wall surfaces which, in the past, occurred with conventional metal studs.

The discontinuous junction flange 40 is greatly superior to a flange which is continuous and uninterrupted. Typically, in a slab of a thickness of one and one-half inches, a continuous junction flange would form a continuous barrier or line of weakness in the slab, to a depth of one half to three quarters of an inch. This is not desirable and may make the panel more fragile.

The material of the slab flows around the locking strip 42 and through the openings 44 in the junction flange 40.

The slab will thus effectively maintain its integrity at least in the region of openings 44, and in this way the slab will be stronger, and it may be possible to use a thinner slab.

In some cases, it is desirable to use panels according to the invention, as flooring, or roofing.

Depending upon the load to be carried, it may be desirable to increase the load-bearing capacity of the studs.

Figure 4:
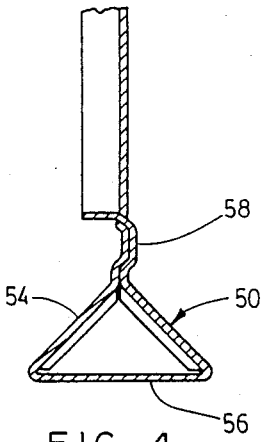
FIG. 4 is a partial section showing a useful feature for a stud member used in the invention.

In accordance with a further embodiment shown in FIG. 4, any or all of the studs may be modified by the provision of a triangular reinforcement tube 50 outwardly of the first surface 13 of the slab 12.

Tube 50 is provided instead of the inner angle portion 20 shown in FIG. 3.

Tube 50 comprises side walls 52 and 54 and bottom wall 56 formed integrally into a triangular shape in section.

Reinforcing ribs may be formed, if desired, at spaced intervals in side walls 52 and 54 for greater strength.

Side walls 52 and 54 are fastened together by any suitable means such as spotwelding, riveting, or integral swaging at 58.

The tubular construction of reinforcement 50 adds increased stress resistance to the strut. By its location in a plane spaced apart from the slab, it is placed in tension and reduces flexing of the slab.

The triangular shape of reinforcement can be replaced by a generally closed T-shaped formation (not shown) if desired.

It is believed that its construction is self-evident and requires no further description.

Since the material of the slab is free to flow through the openings 44 in the junction flanges 40, the slabs resulting from the use of this structure will be considerably stronger, and can carry considerably heavier loads, than is possible using a continuous junction flange.

In addition to these advantages, however, the provision of openings in the junction flange 40 also assists in reducing problems created by differences in the rate of thermal expansion as between the material of the studs themselves, and the slab.

If the openings 44 are formed in only the junction flange 40, the locking strip 42 can be made somewhat narrower than if those openings 44 extend into the locking strip 42.

In use, the panels 10 are usually attached to form the exterior wall of a building although they can be used as interior walls, if desired. Insulation can be placed between the studs, and interior wall panelling, such as gypsum wallboard can be attached the mounting flanges on the interior of the studs.

Reference will next be made to FIG. 5 in which there is indicated generally at 60 an alternative embodiment of a steel stub member for use in a precast panel in accordance with the invention. The stud member 60 is similar to the stud member 14 already described in that it comprises an inner angle portion 62 and an outer angle portion 64, the former being provided with a reinforcing edge flange 65. Struts 66 extend between bracing flanges 67 and 68 and define openings 69 therebetween.

The outer angle portion 62 comprises a mounting flange 70 which is integrally formed with a junction flange 72 which extends therefrom at an acute angle and which is in turn integrally formed with a locking strip 74. Openings 76 are formed in the junction flange 72 and such openings 76 usefully extend partly into the locking strip 74 as actually shown.

Reference will now be made to FIG. 6 in which there is shown generally at 80 yet another embodiment of a stud member for use in a panel in accordance with this invention. Identical components of the stud members 60 and 80 are identified by the same legends to avoid undue duplication of the description herein.

The stud member 80 differs from the stud member 60 in that it is not provided with a mounting flange 70 but instead with a junction flange 82 which is integrally formed with the bracing flange 68 and which extends angularly therefrom. In turn, a locking strip 84 is integrally formed with the junction flange 82 and extends angularly therefrom so as to be disposed at an acute angle to the surface of the slab (not shown).

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A precast thin walled construction panel having low thermal conductivity and comprising a slab of cast concrete material having a first surface, and a plurality of parallel spaced apart steel stud members partially embedded in, and extending from said first surface of said slab, and each said stud member being an integral sheet metal structure and comprising:

two parallel spaced-apart structural members extending parallel to one another;

a plurality of spaced-apart strut members extending integrally between said structural members, said strut members having openings therebetween;

a junction flange integrally formed with and extending angularly from one of said structural members and embedded in said slab and having openings therethrough; and a locking strip integrally formed with said junction flange, disposed non-perpendicularly relative thereto and embedded in said slab inwardly of said first surface thereof, said locking strip being disposed within said slab at an acute angle to said first surface of said slab and extending to one side only of said junction flange, and said cast concrete material extending through said openings in said junction flange.

2. A precast thin walled construction panel as claimed in claim 1 and wherein said openings in said junction flange of each said stud member extend partly into said locking strip thereof.

3. A precast thin walled construction panel as claimed in claim 1 and in which each said stud member additionally comprises a reinforcing tube integrally formed therewith at a position spaced apart outwardly from said first surface of said slab.

4. A precast thin walled construction panel as claimed in claim 1 and in which said junction flange of each said stud member extends into said slab at an acute angle to said first surface thereof.

5. A precast thin walled construction panel as claimed in claim 1 and in which said openings in said strut members are peripherally defined at least in part by flanges integrally formed with said strut members.

6. A precast thin walled construction panel having low thermal conductivity and comprising a slab of cast concrete material having a first surface, and a plurality of parallel spaced apart steel stud members partially embedded in, and extending from said first surface of said slab, and each said stud member being an integral sheet metal structure and comprising:

two parallel spaced-apart structural members extending parallel to one another;

a plurality of spaced-apart strut members extending integrally between said structural members, said strut members having openings therebetween;

a junction flange integrally formed with one of said structural members and extending into said slab at an acute angle to said first surface thereof; and a locking strip integrally formed with said junction flange, disposed non-perpendicularly relative thereto and embedded in said slab inwardly of said first surface thereof, said locking strip being disposed within said slab at an acute angle to said first surface of said slab and extending to one side only of said junction flange, openings being provided in said junction flange and said openings extending into said locking strip, and said cast concrete material extending therethrough.

* * * * *